US012076608B2

(12) United States Patent
Peterson

(10) Patent No.: US 12,076,608 B2
(45) Date of Patent: Sep. 3, 2024

(54) MODULAR EXERCISE SYSTEM

(71) Applicant: David Peterson, Cedarville, OH (US)

(72) Inventor: David Peterson, Cedarville, OH (US)

( * ) Notice: Subject to any disclaimer, the term of this patent is extended or adjusted under 35 U.S.C. 154(b) by 330 days.

(21) Appl. No.: 17/697,215

(22) Filed: Mar. 17, 2022

(65) Prior Publication Data

US 2022/0296956 A1 Sep. 22, 2022

Related U.S. Application Data

(60) Provisional application No. 63/162,048, filed on Mar. 17, 2021.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/02*** | (2006.01) |

(52) U.S. Cl.

CPC ..... *A63B 21/4011* (2015.10); *A63B 21/0442* (2013.01); *A63B 21/0557* (2013.01); *A63B 21/4035* (2015.10); *A63B 23/0233* (2013.01)

(58) Field of Classification Search

CPC ..... A63B 21/4011; A63B 21/0442; A63B 21/0557; A63B 21/4035; A63B 23/0233; A63B 21/0414; A63B 21/0552; A63B 23/0222; A63B 23/0494; A63B 69/0062; A63B 2071/025

See application file for complete search history.

(56) References Cited

U.S. PATENT DOCUMENTS

| | | | | |
|---|---|---|---|---|
| 3,787,048 | A * | 1/1974 | Bock | A63B 21/00047 482/145 |
| 5,029,848 | A * | 7/1991 | Sleamaker | A63B 21/0628 482/96 |
| 5,183,452 | A * | 2/1993 | Bacon | A63B 23/085 482/145 |
| 5,263,919 | A * | 11/1993 | Hollenback | A63B 21/00047 482/145 |
| 6,010,434 | A * | 1/2000 | Hodges | A63B 21/0552 482/130 |
| 6,015,370 | A * | 1/2000 | Pandozy | A63B 23/0233 482/142 |
| 6,692,418 | B2 * | 2/2004 | Shahan | A63B 23/0233 482/148 |
| 6,752,745 | B1 * | 6/2004 | Davis | A63B 21/1609 482/130 |
| 7,128,701 | B1 * | 10/2006 | Ketcham | A63B 23/1254 482/148 |
| 7,427,257 | B1 * | 9/2008 | Chernet | A63B 23/0494 482/142 |
| 7,614,986 | B2 * | 11/2009 | Mattox | A63B 23/0205 482/907 |
| 7,678,033 | B2 * | 3/2010 | Tyree | A63B 21/4035 482/142 |

(Continued)

*Primary Examiner* — Andrew S Lo

(74) *Attorney, Agent, or Firm* — Thomas E. Lees, LLC

(57) ABSTRACT

A system for constructing exercise devices comprises a support frame, a first stanchion, a second stanchion, a knee-pad attachment, a thigh-pad attachment, a roller-pad attachment, and a multi-purpose bar. The system can be assembled in different configurations to allow a user to perform different exercises such as back hyperextensions, sissy squats, Nordic curls, sit ups, and hip thrusters.

20 Claims, 12 Drawing Sheets

(56) References Cited

U.S. PATENT DOCUMENTS 8,062,195 B2 * 11/2011 Israeli ..... A63B 21/068 482/131
8,096,930 B1 * 1/2012 Leon ..... A63B 69/0062 482/130
8,172,736 B2 * 5/2012 Contreras ..... A63B 23/0222 482/142
9,119,984 B2 * 9/2015 Littell ..... A63B 69/0062
9,242,139 B2 * 1/2016 Holley ..... A63B 23/02
9,586,075 B2 * 3/2017 Goodson ..... A63B 21/068
9,630,055 B2 * 4/2017 Runyan ..... A63B 21/00047
9,669,255 B2 * 6/2017 Henniger ..... A63B 23/0211
9,878,203 B1 * 1/2018 Guarnaccia ..... A63B 21/00047
10,420,974 B2 * 9/2019 Henninger ..... A63B 23/0211
10,500,439 B1 * 12/2019 Holman ..... A63B 21/0628
10,953,275 B2 * 3/2021 Porteros De Luz ..... A63B 23/0482
11,077,338 B1 * 8/2021 Levin ..... A63B 21/4034
11,673,020 B1 * 6/2023 Graack ..... A63B 21/0442 482/130
11,865,398 B1 * 1/2024 Parvarandeh ..... A63B 22/0605
2003/0060347 A1 * 3/2003 Tang ..... A63B 23/0222 482/141
2004/0033872 A1 * 2/2004 Nizamuddin .... A63B 21/00047 482/142
2004/0209749 A1 * 10/2004 Planit ..... A63B 23/0405 482/121
2009/0312160 A1 * 12/2009 Higgins ..... A63B 23/025 482/94
2010/0173761 A1 * 7/2010 Zachary ..... A63B 23/0211 482/142
2010/0204027 A1 * 8/2010 Dauterive ..... A61F 5/0116 482/145
2011/0143890 A1 * 6/2011 Reyes ..... A63B 21/154 482/99
2014/0066276 A1 * 3/2014 Hornback ..... A63B 21/00069 482/145
2014/0080685 A1 * 3/2014 Butler ..... A63B 21/154 482/102
2014/0371036 A1 * 12/2014 Ellis ..... A63B 22/001 482/66
2015/0011370 A1 * 1/2015 Henniger ..... A63B 23/0211 482/145
2016/0184629 A1 * 6/2016 Hornback ..... A63B 41/125 482/130
2018/0008857 A1 * 1/2018 Barber ..... A63B 21/0428
2018/0214739 A1 * 8/2018 Anderson ..... A63B 21/00047
2018/0311529 A1 * 11/2018 Sadikaj ..... A63B 69/0062
2020/0114201 A1 * 4/2020 Kim ..... A63B 21/22

* cited by examiner

MODULAR EXERCISE SYSTEM

CROSS REFERENCE TO RELATED APPLICATIONS

This application claims the benefit of U.S. Provisional Patent Application Ser. No. 63/162,048, filed Mar. 17, 2021, entitled "MODULAR EXERCISE SYSTEM", the disclosure of which is hereby incorporated by reference.

BACKGROUND

Various aspects of the present invention relate generally to exercise devices and more particularly to modular reconfigurable exercise systems.

Many people need to exercise to enhance or maintain physical fitness and overall wellness. For example, a back hyperextension is an exercise that works a person's back, mostly the lower back. Another exercise is a sissy squat where the person squats such that the knees remain over the toes as the person leans backwards. A further exercise are Nordic curls, where a person kneels and leans forward at the waist and returns back to a vertical kneeling position. Hip thrusters are an exercise where a person lies down (sometimes on an inclined plane) and thrusts their hips, sometimes with a weighted barbell.

BRIEF SUMMARY

According to aspects of the present invention, a system for constructing exercise devices comprises a support frame, a first stanchion, a second stanchion, a knee-pad attachment, a thigh-pad attachment, a roller-pad attachment, and a foot-plate attachment. The system can be assembled in different configurations to allow a user to perform different exercises such as back hyperextensions, sissy squats, Nordic curls, and hip thrusters.

DETAILED DESCRIPTION

According to aspects of the present disclosure, a modular system is provided to allow a user to perform several different exercises using the same system by moving portions of the equipment around in different configurations. Therefore, the system allows for a smaller footprint (i.e., takes up a relatively small amount of space) than traditional equipment for performing the same exercises. Further, as the system can be disassembled for storage, the system can be stored in a flat configuration. Moreover, the system can be assembled to fit body measurements of different people, depending who the user is.

Disassembled System

Figure 1:
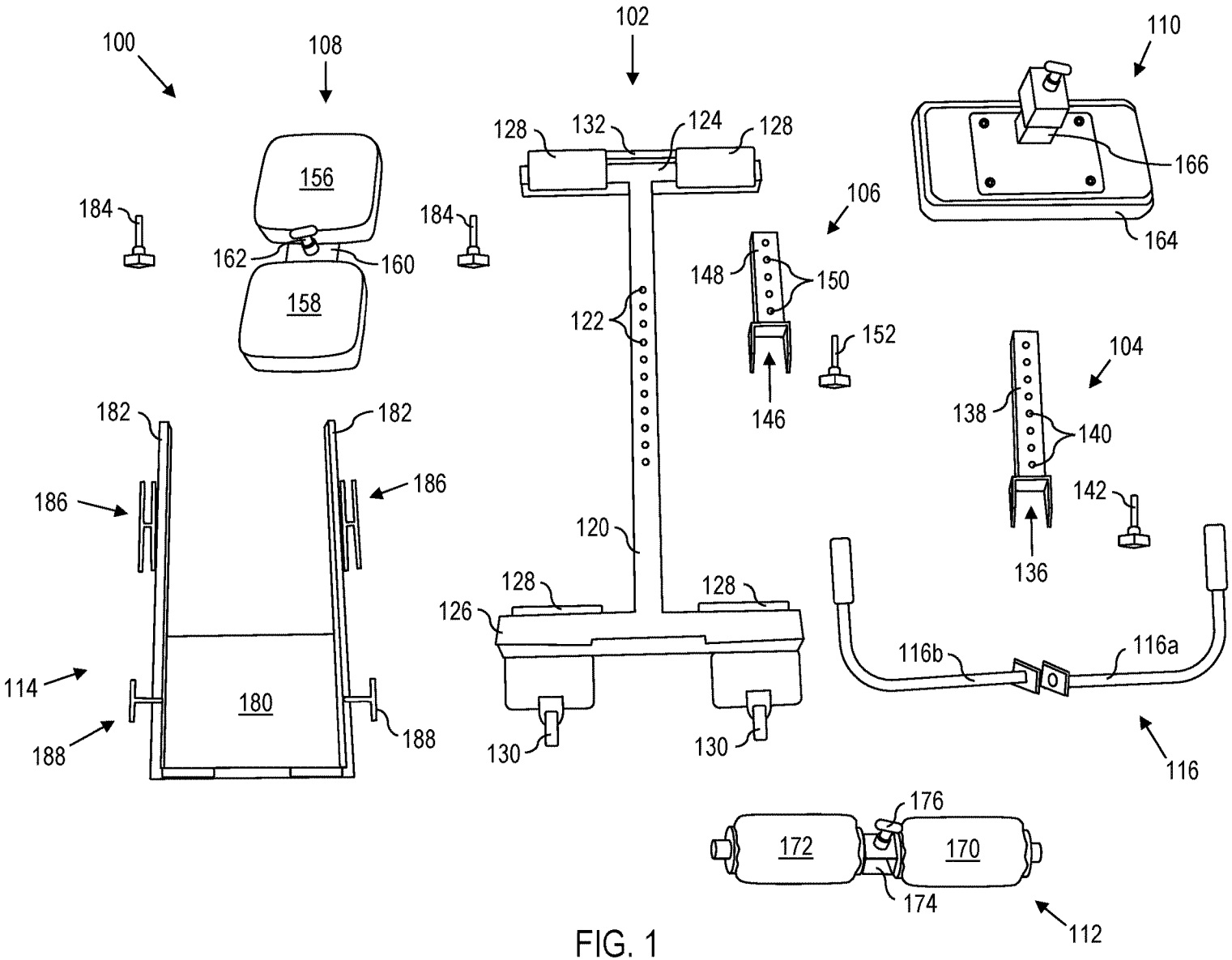
FIG. 1 is an illustration of a first version of a disassembled modular system for performing exercises, according to various aspects of the present disclosure.

Turning now to FIG. 1, a first version of a modular system 100 is shown disassembled. The system 100 includes a support frame 102, a first stanchion 104, a second stanchion 106, a knee-pad attachment 108, a thigh-pad attachment 110, a roller-pad attachment 112, and a foot-plate attachment 114. Some embodiments of the system 100 also include a handle-bar 116 (multi-purpose bar) in two sections 116*a* and 116*b*.

The support frame 102 includes a central support 120 that runs lengthwise along the support frame 102. The central support 120 includes a set of holes 122 that are centrally located on the center support 120. However, more holes or less 122 may be used and the holes may continue a longer or shorter length of the central support 120. Further, sides of the central support 120 include holes (see FIGS. 2-5 below). Again, there may be different number of holes on the sides of the central support 120, and the holes may run a shorter or longer distance on the length of the central support 120.

The support frame 102 further includes two end supports 124, 126, where one end support is at each end of the central support 120 and generally perpendicular to the central support 120. In several embodiments, the first end support 124 includes foot blocks 128, where a user may place their feet during certain exercises. In various embodiments, the first end support 124 includes wheels 130, so a user may easily transport the support frame 102 and any attachments coupled to the support frame 102. In numerous embodiments, the second end support 126 includes foot blocks 128, where a user may place their feet during certain exercises. In many embodiments, the second end support 126 includes a handle 132, so a user may easily lift the support frame 120 for transport on the wheels 130.

As shown in FIG. 1, the support frame 102 has a length of approximately one meter, and the end supports 124, 126 are approximately fifty-two centimeters. However, the support frame 102 and end supports 124, 126 may be any desired length. Further, the holes 122 are spaced approximately 2.5 cm apart in FIG. 1, but any spacing may be implemented. For example, the spacing between holes 122 may be a little over a centimeter to allow a user to fine tune where attachments will be coupled to the support frame 102.

The first stanchion 104 includes a channel 136 and a column 138, where the channel 136 is sized to fit around the central support 120. Moreover, the column 138 includes holes 140 for coupling other attachments to the first stanchion 104, and the channel 136 includes holes as well to couple the first stanchion 104 to the support frame 102 via the holes on the side of the central support 120. A coupler pin 142 fits in the holes in the channel 136 to couple the first stanchion 104 to the support frame 102.

The second stanchion 106 includes a channel 146 and a column 148, where the channel 146 is sized to fit around the central support 120. Moreover, the column 148 includes holes 150 for coupling other attachments to the second stanchion 106, and the channel 146 includes holes as well to couple the second stanchion 106 to the support frame 102 via the holes on the side of the central support 120. As shown in FIG. 1, the second stanchion 106 is shorter than the first stanchion 104, but the second stanchion 106 may be longer or the same size as the first stanchion 104. A coupler pin 152 fits in the holes in the channel 146 to couple the second stanchion 106 to the support frame 102.

In FIG. 1, the first stanchion 104 is approximately thirty-five centimeters, and the second stanchion 106 is approximately twenty-eight centimeters. However, the stanchions 104, 106 may be any desired height. Further, similar to the support frame 102, the holes 140, 150 on the columns 138, 148 may encompass any length of the column 138, 148 and can have any desired spacing between the holes.

The knee-pad attachment 108 includes a first pad 156 and a second pad 158 coupled together by a bar 160 with a removable coupler 162 for coupling the knee-pad attachment 108 to the central support 120 via the holes 122 of the central support 120. To couple the knee-pad attachment 108 to the central frame 120, the knee-pad attachment 108 is placed underneath the central frame 120 such that the removable coupler 162 can be placed in the holes of the central support 120 to secure the knee-pad attachment 108.

As shown in FIG. 1, the first pad 156 and the second pad 158 are approximately twenty-two centimeters by twenty-two centimeters, but any dimensions that will support a kneeling person may be used. The bar 160 (and thus a space between the two pads 156, 158) should be wide enough to allow the central support 120 to rest on the bar 160 without rubbing the pads 156, 158, so the central support 120 does not destroy the knee-pad attachment 108 during use. However, such measurements are not required.

The thigh-pad attachment 110 includes a pad 164 coupled to a column 166 that includes a removable coupler 168 for coupling the thigh-pad attachment 110 to one of the stanchions 104, 106. In FIG. 1, the thigh-pad attachment 110 is approximately twenty-seven centimeters by forty-seven centimeters, but any sized pad 164 may be used.

The roller-pad attachment 112 includes two roller pads 170, 172 separated by a bar 174 that includes a removable coupler 176 that allows the roller-pad attachment 112 to be coupled to the support frame 102 or a stanchion 104, 106, as discussed above. In FIG. 1, the roller-pad attachment has a fifty-four centimeter axis and a thirteen centimeter diameter, but any similar dimensions may be used.

The foot-plate attachment 114 includes a foot plate 180 and arms 182 that allow the foot-plate attachment 114 to be coupled to the first or second end support 124, 126 via two couplers 184. Moreover, the foot plate 180 may include a textured surface, a non-slip surface, or a slip-resistant surface. Further, the foot-plate attachment 114 includes resistance-band holders 186 that allow a user to place a resistance band (192, FIG. 5) in the foot-plate attachment 114 to provide resistance to the user during certain exercises (e.g., hip thrusters). While the resistance-band holders 186 are shown in FIG. 1 as open ended, the resistance-band holders 186 may be closed. Further, as shown in FIG. 1, the resistance-band holders 186 are two bars, but there may be more bars (e.g., three, four, more) or only one bar. The farther out the resistance band is on the resistance-band holders 186, the more Moreover, the foot-plate attachment includes targeted resistance-band coupling points 188 so the resistance band (s) may be used for curls and other exercises using the multi-purpose bar 116 as one piece together or as two separate pieces 116*a*, 116*b*. These curls and other exercises may be performed while the user is standing on the foot plate 180.

As shown in FIG. 1, the foot-plate attachment 114 is ninety-five to one-hundred-and-twelve centimeters long by fifty-six centimeters wide, where the foot plate 180 extends forty centimeters. However, any dimensions that allow the foot-plate attachment 114 to be coupled to one of the end supports 124, 126 may be used.

Figure 6:
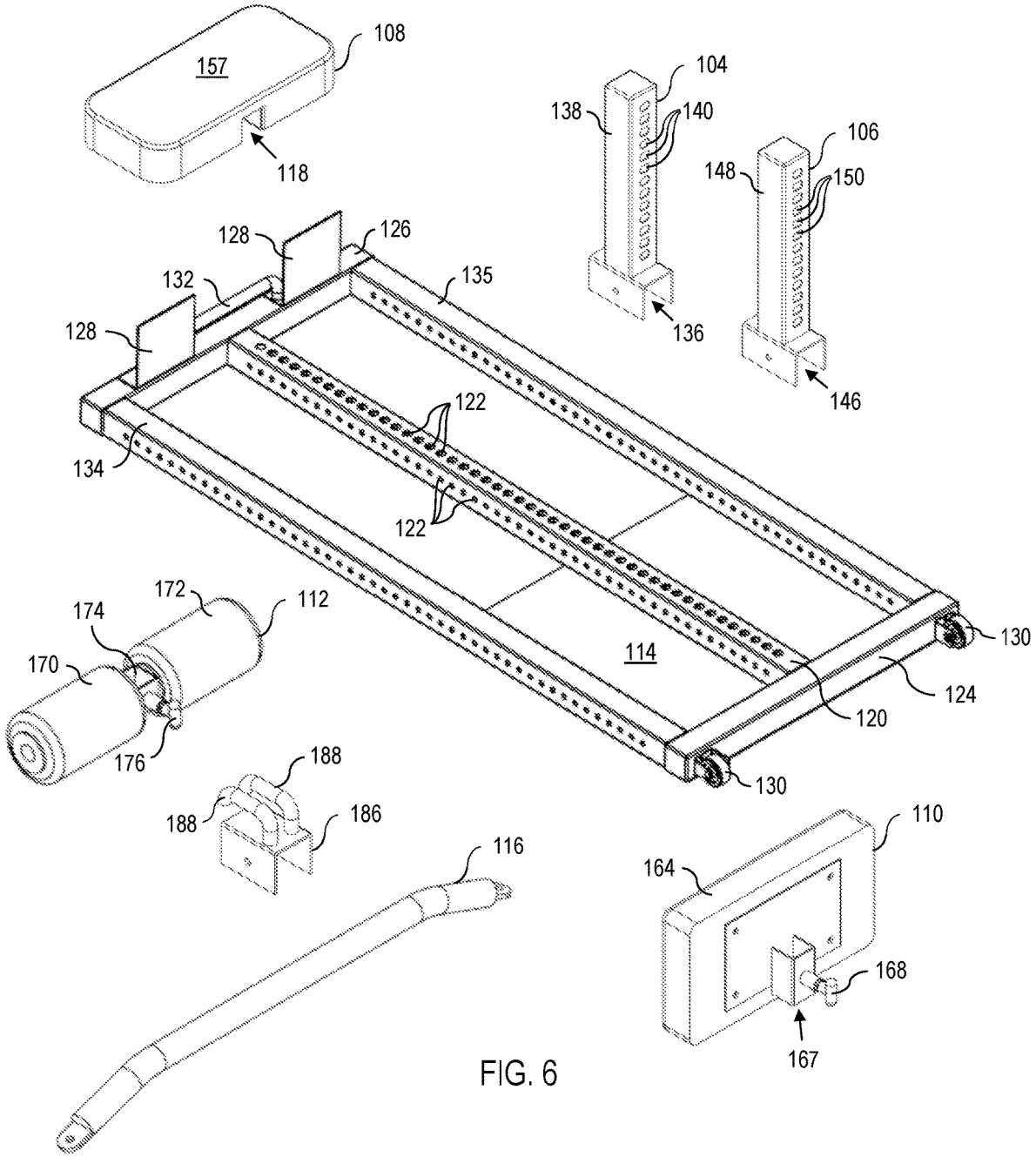
FIG. 6 is an illustration of a second version of a disassembled modular system for performing exercises, according to various aspects of the present disclosure.

FIG. 6 illustrates a second version of the modular system 100. The elements of the first version of the modular system 100 and elements of the second version of the system 100 may be interchanged as feasible. Similar to the first version, the second version of the system includes a support frame 102, a first stanchion 104, a second stanchion 106, a knee-pad attachment 108, a thigh-pad attachment 110, and a roller-pad attachment 112. However, the support frame 102 includes an integral foot plate 114. Some embodiments of the system 100 include a multi-purpose bar (handlebar) 116.

Similar to the support frame 102 of the first version, the support frame 102 of the second version a central support 120 that runs lengthwise along the support frame 102. The central support 120 includes a set of holes 122 that are centrally located on the center support 120. However, more holes or less 122 may be used and the holes may continue a longer or shorter length of the central support 120. Further, sides of the central support 120 include holes. Again, there may be different number of holes on the sides of the central support 120, and the holes may run a shorter or longer distance on the length of the central support 120.

The support frame 102 further includes two end supports 124, 126, where one end support is at each end of the central support 120 and generally perpendicular to the central support 120. In various embodiments, the first end support 124 includes wheels 130, so a user may easily transport the support frame 102 and any attachments coupled to the support frame 102. In numerous embodiments, the second end support 126 includes foot blocks 128, where a user may place their feet during certain exercises. In many embodiments, the second end support 126 includes a handle 132, so a user may easily lift the support frame 120 for transport on the wheels 130. The support frame 102 of FIG. 6 includes two reinforcement bars 134, 135 that run parallel to the central support 120. These reinforcement bars 134, 135 provide stability to the frame 102 and include holes 122 similar to the holes 122 of the central support 120.

Similar to the embodiment of FIG. 1, the first stanchion 104 includes a channel 136 and a column 138, where the channel 136 is sized to fit around the central support 120. Moreover, the column 138 includes holes 140 for coupling other attachments to the first stanchion 104, and the channel 136 includes holes as well to couple the first stanchion 104 to the support frame 102 via the holes on the side of the central support 120. A coupler pin fits in the holes in the channel 136 to couple the first stanchion 104 to the support frame 102.

The second stanchion 106 includes a channel 146 and a column 148, where the channel 146 is sized to fit around the central support 120. Moreover, the column 148 includes holes 150 for coupling other attachments to the second stanchion 106, and the channel 146 includes holes as well to couple the second stanchion 106 to the support frame 102 via the holes on the side of the central support 120. As shown in FIG. 6, the second stanchion 106 is the same size as the first stanchion 104, but the second stanchion 106 may be longer or shorter than the first stanchion 104. A coupler pin fits in the holes in the channel 146 to couple the second stanchion 106 to the support frame 102.

The knee-pad attachment 108 of FIG. 6 includes an integral pad 157 couples to the central support 120 via a stud (not shown) in a channel 118 that fits the holes 122 of the central support 120.

The thigh-pad attachment 110 includes a pad 164 coupled to a channel 167 that includes a coupler 168 for coupling the thigh-pad attachment 110 to one of the stanchions 104, 106. The coupler 168 of FIG. 6 is integral to the attachment 110 and spring loaded for coupling to one of the stanchions, as described herein.

The roller-pad attachment 112 includes two roller pads 170, 172 separated by a bar 174 that includes an integral coupler 176 that allows the roller-pad attachment 112 to be coupled to the support frame 102 or a stanchion 104, 106, as discussed above.

The system 100 of FIG. 6 further includes removable resistance-band holders 186 with resistance-band coupling points 188. As the foot plate attachment 114 of the version of FIG. 6 is integral to the frame 102, two removable resistance-band holders 186 that may be coupled to the reinforcement bars 134, 135 of the frame 102 for use with resistance bands (not shown) as discussed above.

The system 100 and embodiments thereof described above may be used for many different exercises including (but not limited to) back hyperextensions, sissy squats, Nordic curls, sit-ups, and hip thrusters, where the hip thrusters may be performed in a way that is not currently available on existing machines.

Assembled System for Back Hyperextensions

Figure 2:
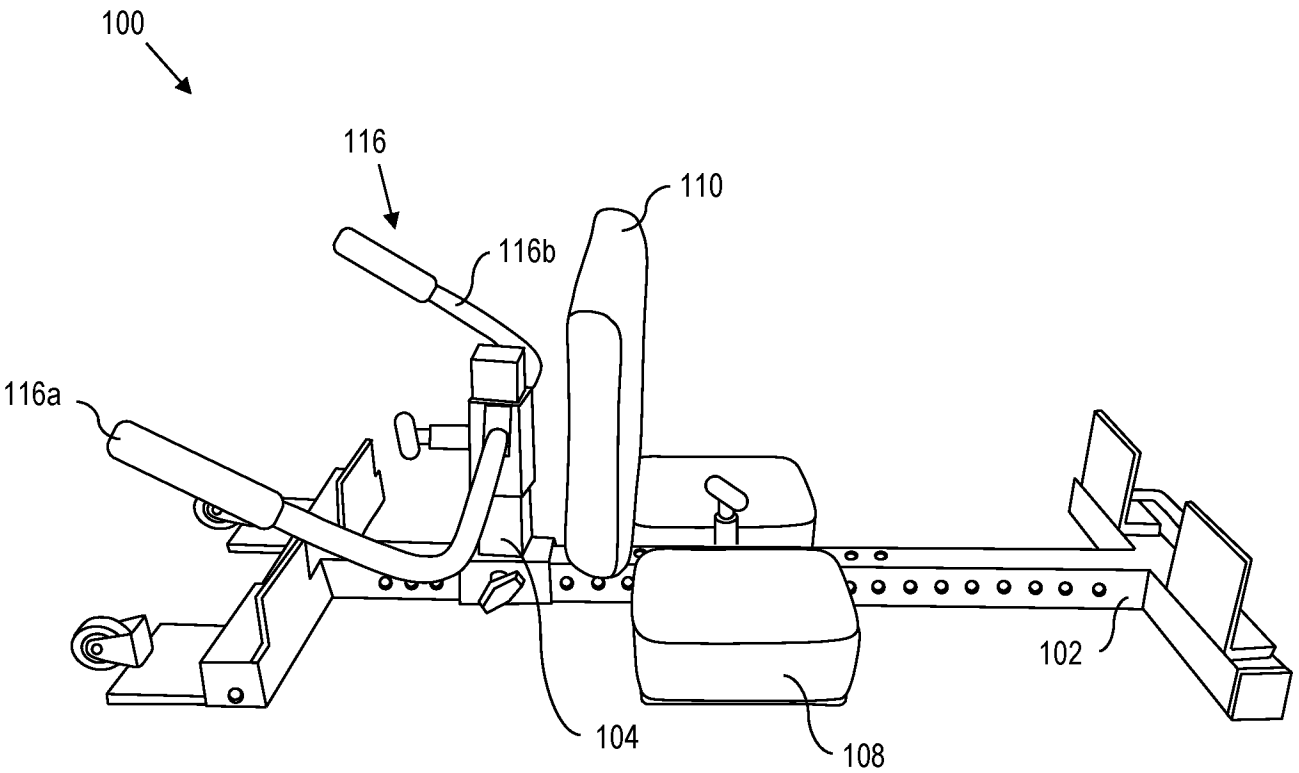
FIG. 2 is an illustration of the modular system of FIG. 1 assembled for performing back hyperextensions, according to various aspects of the present disclosure.

Turning now to FIG. 2, a side view of the system 100 of FIG. 1 assembled for performing back hyperextensions is shown. To assemble the system 100 for back hyperextensions, a user couples the knee-pad attachment 108 to the support frame 102 as discussed above. Further, the user couples the thigh-pad attachment 110 to the first stanchion 104. Then, the user couples the first stanchion 104 to the support frame 102 at a position relative to the knee-pad attachment 108 such that the thigh-pad attachment and the knee-pad attachment create a right angle so when the user places their knee on the knee-pad attachment 108, the user's thighs are touching the thigh-pad attachment 110. The placement of the knee-pad attachment 108 may be anywhere along the support frame 102, but enough room should be left for the thigh-pad attachment 110.

In some embodiments, the multi-purpose bar 116 is coupled to the thigh-pad attachment 110 or the first stanchion, where the first part of the multi-purpose bar 116*a* is on one side of the stanchion 104 and the second part of the multi-purpose bar 116*b* is on the other side of the stanchion 104.

Figure 7:
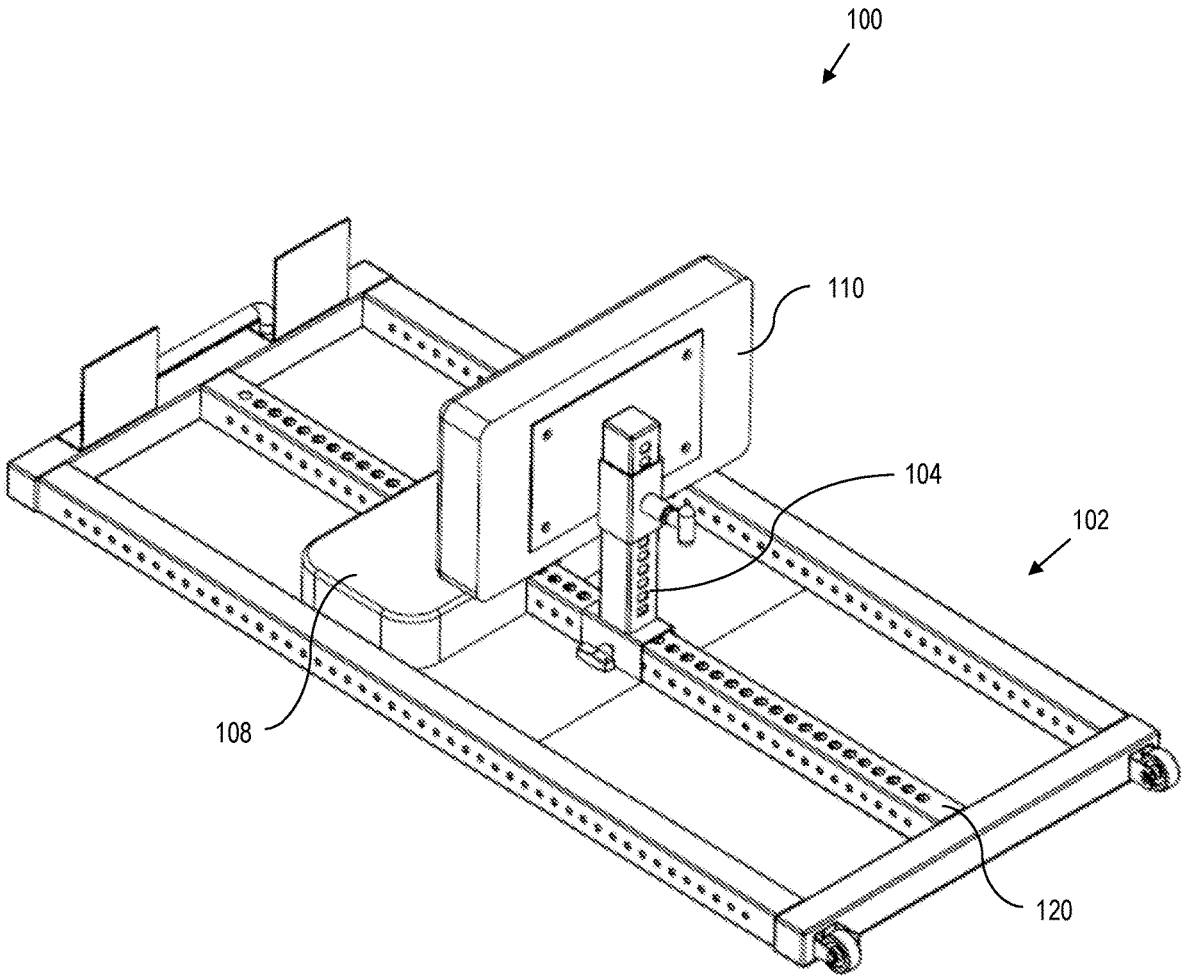
FIG. 7 is an illustration of the modular system of FIG. 6 assembled for performing back hyperextensions, according to various aspects of the present disclosure.

FIG. 7 shows the version of the system 100 of FIG. 6 assembled for performing back hyperextensions. The knee pad attachment 108 is placed on the central support 120, where the stud fits into a hole of the central support 120. Further, the user couples the thigh-pad attachment 110 to the first stanchion 104. Then, the user couples the first stanchion 104 to the support frame 102 at a position relative to the knee-pad attachment 108 such that the thigh-pad attachment and the knee-pad attachment create a right angle so when the user places their knee on the knee-pad attachment 108, the user's thighs are touching the thigh-pad attachment 110. The placement of the knee-pad attachment 108 may be anywhere along the support frame 102, but enough room should be left for the thigh-pad attachment 110.

Assembled System for Sissy Squats

Figure 3:
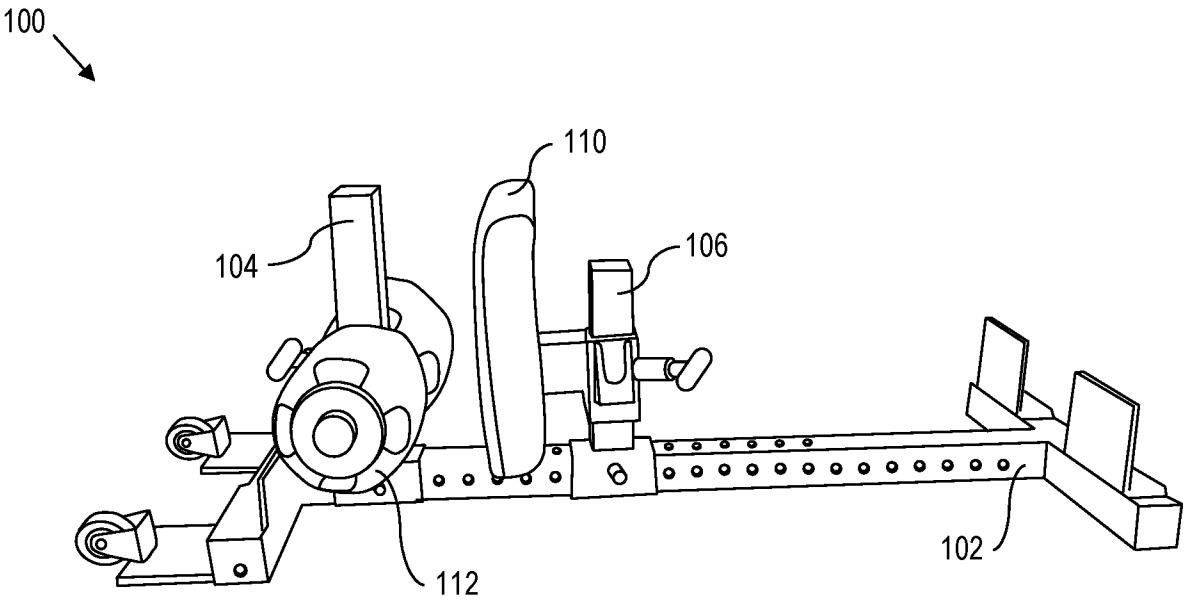
FIG. 3 is an illustration of the modular system of FIG. 1 assembled for performing sissy squats, according to various aspects of the present disclosure.

Turning now to FIG. 3, a side view of the system 100 of FIG. 1 assembled for performing sissy squats is shown. To assemble the system 100 for sissy squats, a user couples the roller-pad attachment 112 to the first stanchion 104. Then, the user couples the first stanchion 104 to the support frame 102. Moreover, the user couples the thigh-pad attachment 110 to the second stanchion 106 and then couples the second stanchion 106 to the support frame 102 apart from the first stanchion 104 such that the user can fit their legs between the thigh-pad attachment 110 and the roller attachment 112 (e.g., between ten to eighteen centimeters).

Figure 8:
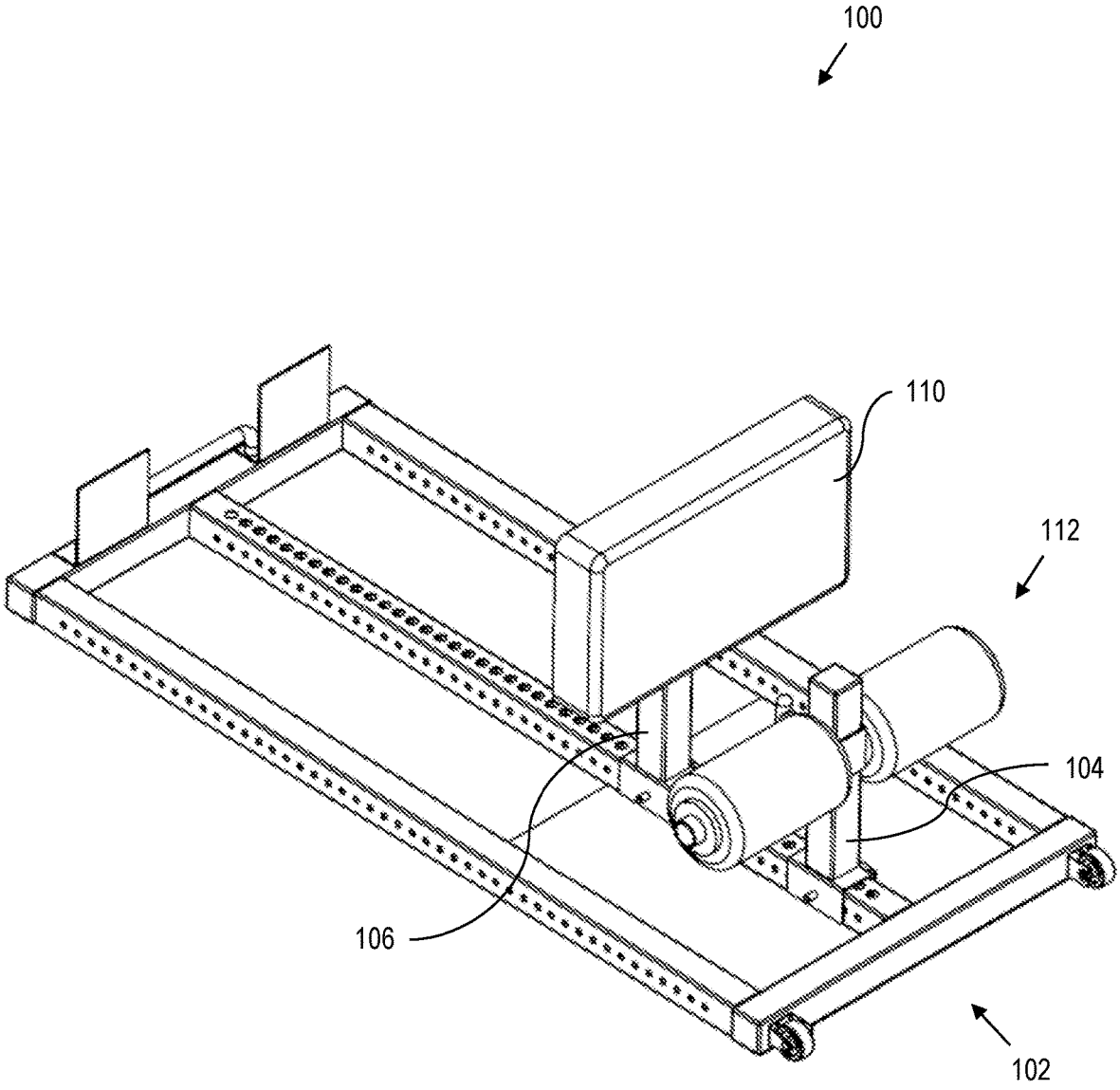
FIG. 8 is an illustration of the modular system of FIG. 6 assembled for performing sissy squats, according to various aspects of the present disclosure.

FIG. 8 illustrates a side view of the system 100 of FIG. 6 assembled for performing sissy squats. Assembly is similar to the method discussed in reference to FIG. 3.

Assembled System for Nordic Curls

Figure 4:
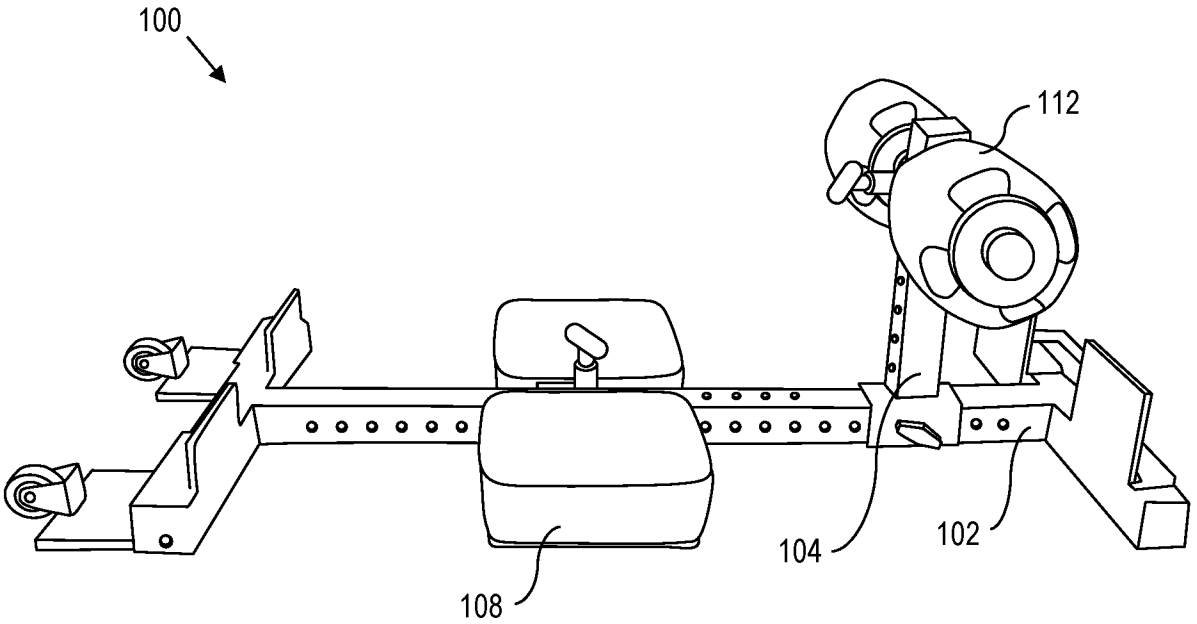
FIG. 4 is an illustration of the modular system of FIG. 1 assembled for performing Nordic curls, according to various aspects of the present disclosure.

Turning now to FIG. 4, a side view of the system 100 of FIG. 1 assembled for performing Nordic curls is shown. To assemble the system 100 for Nordic curls, a user couples the knee-pad attachment 108 to the support frame 102 as discussed above. Further, the user couples the roller-pad attachment 112 to the first stanchion 104. Then, the user couples the first stanchion 104 to the support frame 102 far enough away from the knee-pad attachment 108 such that when the user is kneeling on the knee-pad attachment 108, the user can hook their ankles on the roller-pad attachment 112.

Figure 9:
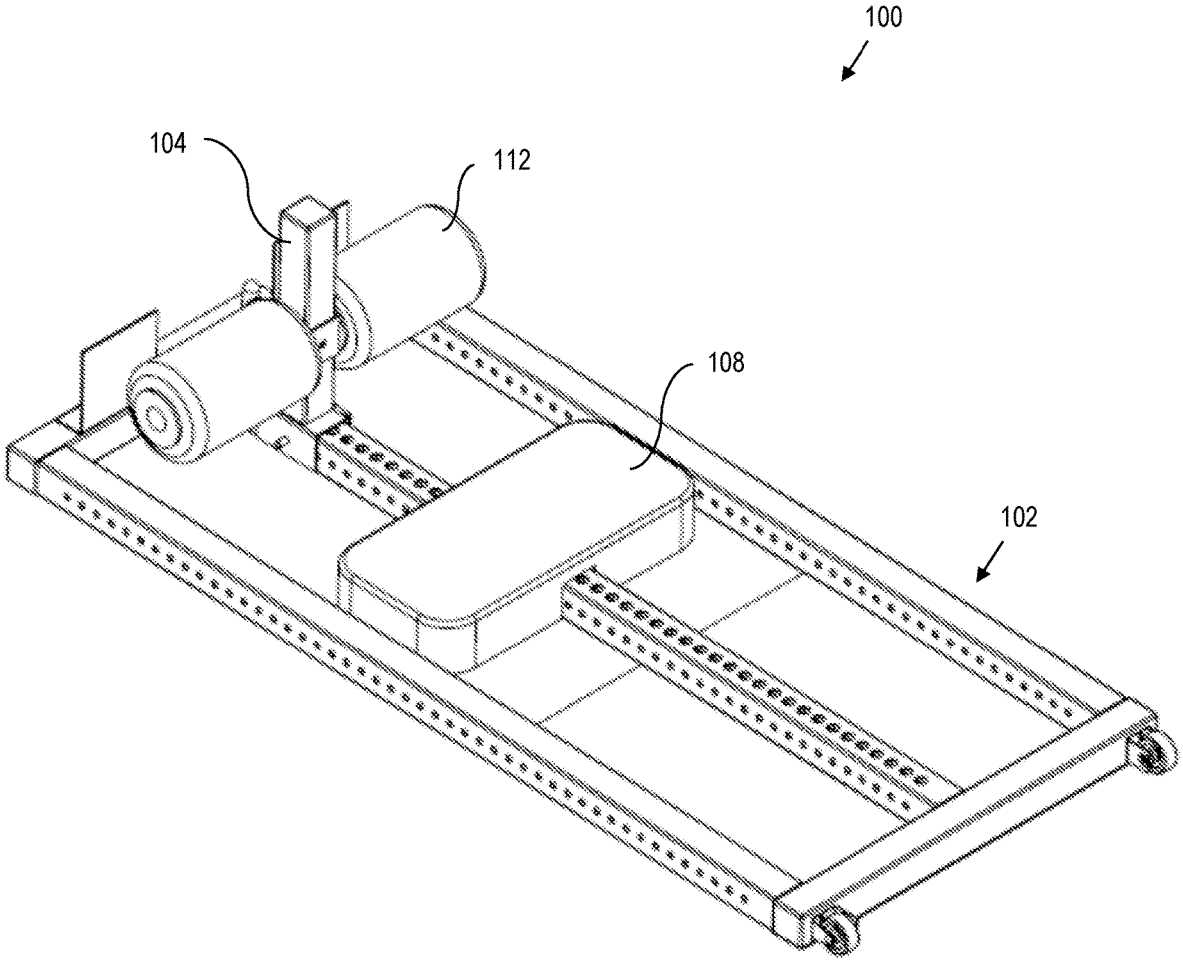
FIG. 9 is an illustration of the modular system of FIG. 6 assembled for performing Nordic curls, according to various aspects of the present disclosure.

FIG. 9 illustrates the system 100 of FIG. 6 assembled for performing Nordic curls. Assembly is similar to the method discussed in reference to FIG. 4.

Assembled System for Hip Thrusters

Figure 5:
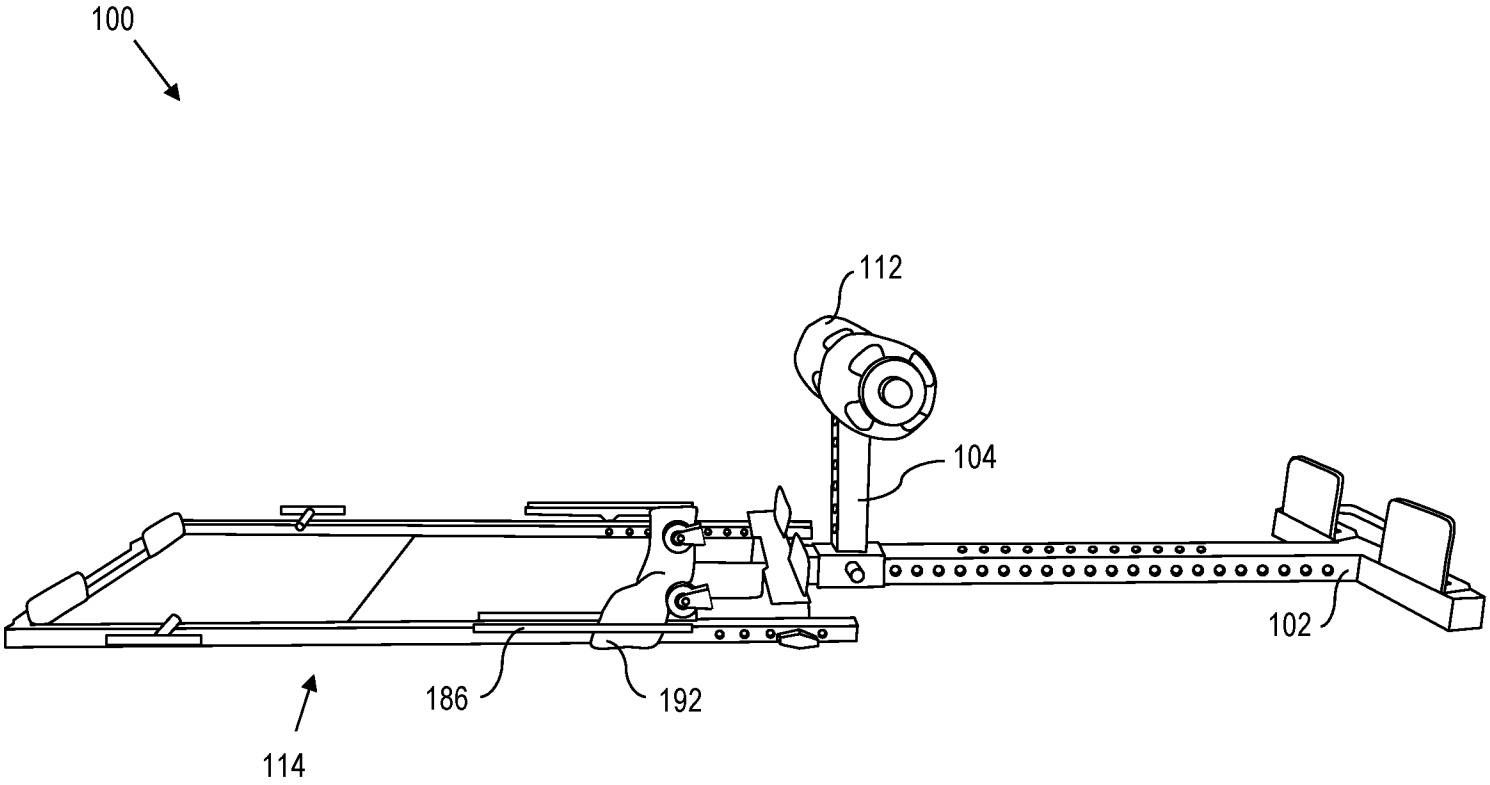
FIG. 5 is an illustration of the modular system of FIG. 1 assembled for performing hip thrusters, according to various aspects of the present disclosure.

Turning now to FIG. 5, a side view of the system 100 of FIG. 1 assembled for performing hip thrusters is shown. To assemble the system 100 for hip thrusters, a user couples the roller-pad attachment 112 to the first stanchion 104. Then, the user couples the foot-plate attachment 114 to the second end portion 126 (or first end portion 124 of FIG. 1) of the support frame 102. Optionally, the user couples a resistance band 192 across the two resistance-band holders 186 of the foot-plate attachment 114. This setup provides for the user to be in a sitting position at a generally right angle when performing hip thrusters. Further, the roller-pad attachment 112 provides back support during the hip thrusters.

Figure 10:
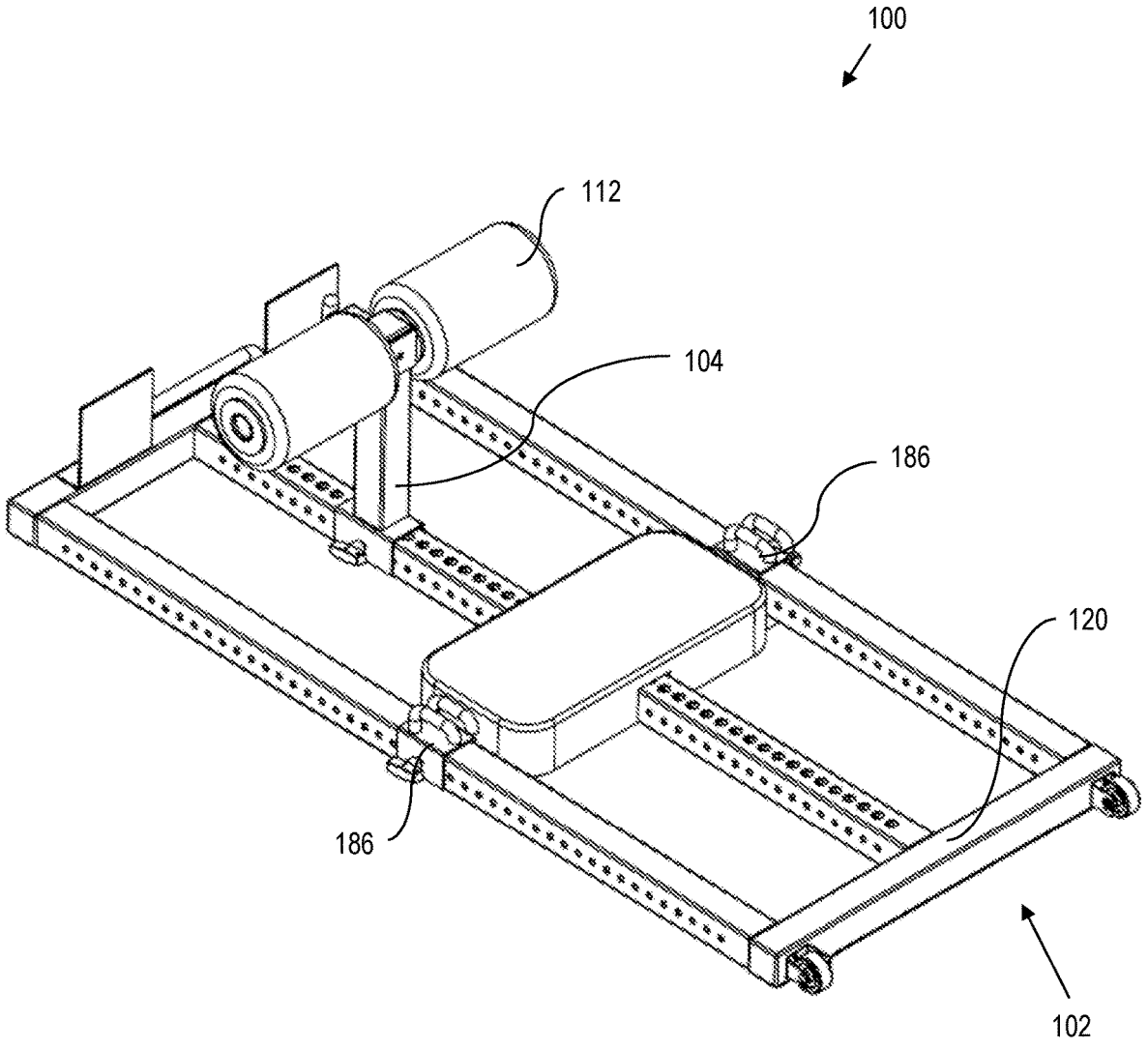
FIG. 10 is an illustration of the modular system of FIG. 6 assembled for performing hip thrusters, according to various aspects of the present disclosure.

FIG. 10 illustrates the system 100 of FIG. 6 assembled for performing hip thrusters. To assemble the system 100 of FIG. 6 for hip thrusters, a user couples the roller-pad attachment 112 to the first stanchion 104 (slightly lower on the stanchion that a height chosen for Nordic curls) for coupling to the center support 120 of the frame 102. Then, the user couples the removable resistance-band holders 186 if desired (along with associated resistance bands). This setup provides for the user to be in a sitting position at a generally right angle when performing hip thrusters. Further, the roller-pad attachment 112 provides back support during the hip thrusters.

Assembled System for Multi-Purpose Bar

Figure 11:
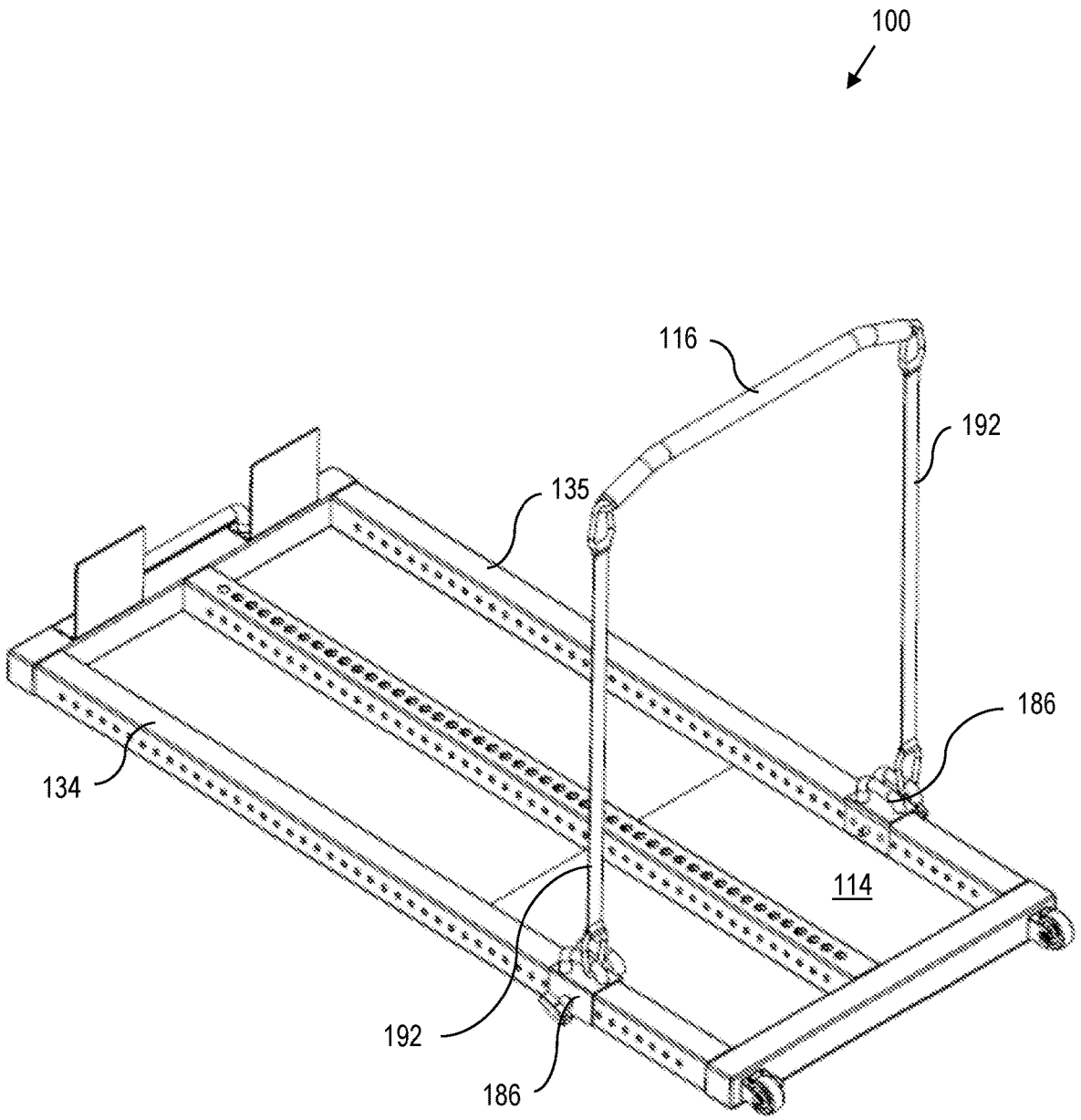
FIG. 11 is an illustration of the modular system of FIG. 6 assembled for curls and other exercises utilizing a multi-purpose bar and resistance bands, according to various aspects of the present disclosure.

FIG. 11 illustrates the system 100 of FIG. 6 assembled with the multi-purpose bar 116. The multi-purpose bar 116 couples to the removable resistance-band holders 186 (which are coupled to the reinforcement bars 134, 135 of the frame 102) via resistance bands 192. A user can then stand on the foot plate 114 and perform various exercises with the multi-purpose bar 116, where the resistance bands 192 are used in the execution of various strength training exercises (e.g., bicep curls, overhead press, bent-over rows, squats, etc.).

Assembled System for Sit Ups

Figure 12:
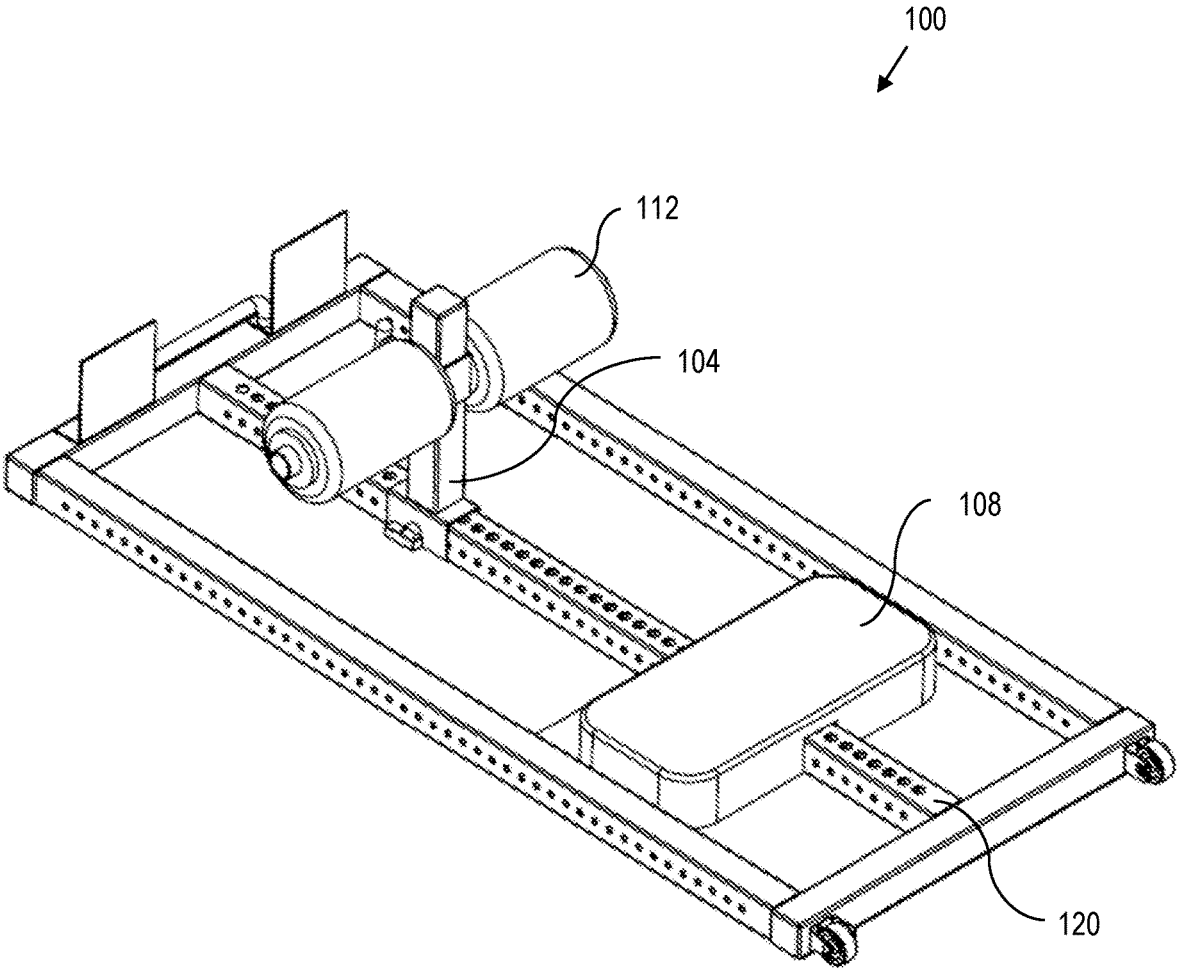
FIG. 12 is an illustration of the modular system of FIG. 6 assembled for performing sit ups, according to various aspects of the present disclosure.

FIG. 12 illustrates the system 100 of FIG. 6 assembled for sit ups. To assemble the system 100 of FIG. 6 for sit ups, a user couples the roller-pad attachment 112 to the first stanchion 104 and the knee pad attachment 108 couples to the center support 120. This setup provides for the user to lock ankles under the roller pad attachment 112 and sit on the knee-pad attachment 108 to perform sit ups.

Miscellaneous

The assembly instructions in reference to Figures above may be performed in any order for a specific exercise. For example, the instructions include coupling the attachment(s) to the stanchion(s) before coupling the stanchion(s) to the support frame. However, in any of those cases, the stanchion (s) may be coupled to the support frame first and then the attachment(s) may be coupled to the stanchion(s). Further, the any of the different attachments of each embodiment of the system 100 may be used with other embodiments of the system 100, as applicable. For example, the knee-pad attachment of FIG. 6 may be used with the frame 102 of FIG. 1.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the invention in the form disclosed. Many modifications and variations will be apparent to those of ordinary skill in the art without departing from the scope and spirit of the invention. Aspects of the disclosure were chosen and described in order to best explain the principles of the invention and the practical application, and to enable others of ordinary skill in the art to understand the invention for various embodiments with various modifications as are suited to the particular use contemplated.

What is claimed is:

1. A system for constructing exercise devices, the system comprising:

a support frame with a central support running lengthwise on the support frame;

a first stanchion that removably couples to the support frame;

a second stanchion that removably couples to the support frame;

a knee-pad attachment that removably couples to the support frame;

a thigh-pad attachment that removably couples to the support frame;

a roller-pad attachment that removably couples to the support frame; and a multi-purpose bar;

wherein:

the knee-pad attachment is coupled to the central support;

the thigh-pad attachment is coupled to the first stanchion; and the first stanchion is coupled to the central support at a position relative to the knee-pad attachment such that the thigh-pad attachment and the knee-pad attachment create a right angle so when the user places their knee on the knee-pad attachment, the user's thighs are touching the thigh-pad attachment.

2. A system for constructing exercise devices, the system comprising:

a support frame with a central support running lengthwise on the support frame;

a first stanchion that removably couples to the support frame;

a second stanchion that removably couples to the support frame;

a knee-pad attachment that removably couples to the support frame;

a thigh-pad attachment that removably couples to the support frame;

a roller-pad attachment that removably couples to the support frame; and a multi-purpose bar;

wherein:

the roller-pad attachment is coupled to the first stanchion;

the thigh-pad attachment is coupled to the second stanchion;

the first stanchion is coupled to the central support; and the second stanchion is coupled to the central support between ten to eighteen centimeters apart from the first stanchion.

3. A system for constructing exercise devices, the system comprising:

a support frame with a central support running lengthwise on the support frame;

a first stanchion that removably couples to the support frame;

a second stanchion that removably couples to the support frame;

a knee-pad attachment that removably couples to the support frame;

a thigh-pad attachment that removably couples to the support frame;

a roller-pad attachment that removably couples to the support frame; and a multi-purpose bar;

wherein:

the knee-pad attachment is coupled to the central support;

the roller-pad attachment is coupled to the first stanchion; and the first stanchion is coupled to the central support.

4. A system for constructing exercise devices, the system comprising:

a support frame with a central support running lengthwise on the support frame;

a first stanchion that removably couples to the support frame;

a second stanchion that removably couples to the support frame;

a knee-pad attachment that removably couples to the support frame;

a thigh-pad attachment that removably couples to the support frame;

a roller-pad attachment that removably couples to the support frame; and a multi-purpose bar;

wherein:

the roller-pad attachment is coupled to the first stanchion;

the first stanchion is coupled to the support frame;

resistance band holders are coupled to reinforcement bars of the support frame;

a resistance band is coupled between the resistance band holders.

5. A system for constructing exercise devices, the system comprising:

a support frame with:

a central support running lengthwise on the support frame;

a foot plate;

a first reinforcement bar; and a second reinforcement bar;

a first stanchion that removably couples to the support frame;

a second stanchion that removably couples to the support frame;

a knee-pad attachment that removably couples to the support frame;

a thigh-pad attachment that removably couples to the support frame;

a roller-pad attachment that removably couples to the support frame;

a multi-purpose bar;

a first removable resistance band holder is coupled to the first reinforcement bar near the foot plate;

a second removable resistance band holder is coupled to the second reinforcement bar near the foot plate;

a first resistance band is coupled between the first removable resistance band holder and the multi-purpose bar; and a second resistance band is coupled between the second removable resistance band holder and the multi-purpose bar.

6. A system for constructing exercise devices, the system comprising:

a support frame;

a first stanchion that removably couples to the support frame;

a second stanchion that removably couples to the support frame;

a knee-pad attachment that removably couples to the support frame;

a thigh-pad attachment that removably couples to the support frame;

a roller-pad attachment that removably couples to the support frame; and a foot-plate attachment including resistance-band holders with resistance-band coupling points.

7. The system of claim 6, wherein the support frame comprises:

a central support that runs lengthwise on the frame;

a first end support that is at a first end of the central support and perpendicular to the central support; and a second end support that is at a second end of the central support and perpendicular to the central support.

8. The system of claim 7, wherein the support frame further comprises:

foot blocks coupled to the first end support.

9. The system of claim 8, wherein the support frame further comprises:

foot blocks coupled to the second end support.

10. The system of claim 7, wherein the support frame further comprises:

wheels coupled to the first end support.

11. The system of claim 7, wherein the central support includes holes.

12. The system of claim 7, wherein the support frame further comprises:

a first reinforcement bar that couples between the first end support and the second end support; and a second reinforcement bar that couples between the first end support and the second end support;

wherein the first reinforcement bar and the second reinforcement bar run generally parallel to the central support.

13. The system of claim 6, wherein the foot-plate attachment is integral to the support frame.

14. The system of claim 13, wherein the foot-plate attachment removably couples to the support frame.

15. The system of claim 6 further comprising:

removable resistance band holders that couple to the support frame.

16. The system of claim 15 further comprising:

resistance bands that couple to resistance-band coupling points of the removable resistance band holders.

17. The system of claim 6 further comprising a multi-purpose bar.

18. The system of claim 17 further comprising:

removable resistance band holders that couple to the support frame, wherein the removable resistance band holders include resistance-band coupling points; and resistance bands that couple between the resistance-band coupling points and the multi-purpose bar.

19. A system for constructing exercise devices, the system comprising:

a support frame comprising:

a central support that runs lengthwise on the frame;

a first end support that is at a first end of the central support and perpendicular to the central support;

a second end support that is at a second end of the central support and perpendicular to the central support; and wheels coupled to the first end support;

a first stanchion that removably couples to the support frame;

a second stanchion that removably couples to the support frame;

a knee-pad attachment that removably couples to the support frame;

a thigh-pad attachment that removably couples to the support frame;

a roller-pad attachment that removably couples to the support frame; and a foot-plate attachment.

20. A system for constructing exercise devices, the system comprising:

a support frame comprising:

a central support that runs lengthwise on the frame;

a first end support that is at a first end of the central support and perpendicular to the central support;

a second end support that is at a second end of the central support and perpendicular to the central support;

a first reinforcement bar that couples between the first end support and the second end support; and a second reinforcement bar that couples between the first end support and the second end support;

wherein the first reinforcement bar and the second reinforcement bar run generally parallel to the central support;

a first stanchion that removably couples to the support frame;

a second stanchion that removably couples to the support frame;

a knee-pad attachment that removably couples to the support frame;

a thigh-pad attachment that removably couples to the support frame;

a roller-pad attachment that removably couples to the support frame; and a foot-plate attachment.

* * * * *